United States Patent [19]

Reeder et al.

[11] Patent Number: 4,903,816

[45] Date of Patent: Feb. 27, 1990

[54] COIN DROP MOUNTING MECHANISM

[75] Inventors: Bruce L. Reeder; Joseph M. Wilson, both of Frederick; Stephen D. Wade, Keymar, all of Md.

[73] Assignee: North American Philips Corporation, New York, N.Y.

[21] Appl. No.: 352,589

[22] Filed: May 15, 1989

[51] Int. Cl.[4] ..... G07F 9/00; G07F 1/04

[52] U.S. Cl. ..... 194/350; 194/219; 194/231; 194/244; 411/14; 220/243

[58] Field of Search ..... 194/219, 220, 221, 222, 194/223, 230, 231, 239, 240, 241, 242, 244, 245, 246, 343, 344, 350, 353; 411/14, 400; 232/43.1; 220/243, 256, 315

[56] References Cited

U.S. PATENT DOCUMENTS

| | | | |
|---|---|---|---|
| 593,355 | 11/1897 | Harris | 411/400 X |
| 1,765,595 | 6/1930 | Levon | 411/400 X |
| 2,330,186 | 9/1943 | Jetseck et al. | 194/230 X |
| 3,297,123 | 1/1967 | Hutchins | 194/343 |
| 3,455,425 | 7/1969 | Douglas | 194/239 X |
| 3,927,750 | 12/1975 | Greenwald et al. | 194/350 X |
| 4,133,419 | 1/1979 | Greenwald et al. | 194/350 |
| 4,515,261 | 5/1985 | Prisant | 194/350 |
| 4,545,474 | 10/1985 | Ridgley et al. | 194/350 |

*Primary Examiner*—Joseph J. Rolla
*Assistant Examiner*—Edward S. Ammeen

[57] ABSTRACT

Apparatus for affixing a coin drop mechanism to the front panel of a vending machine in situations where internal tactile and visual access to the rear surface of the machine panel is limited. An external plate assembly includes guide rods extending from threaded studs which are used to align an internal plate assembly supporting the end drive mechanism. Internally threaded tubular locking fixtures applied over the guide rods to engage the studs for clamping the first and second plate assemblies around the panel. When proper assembly has been achieved the tip to the guide rods extends to the locking members to provide a tactical indication that proper installation has been achieved.

5 Claims, 2 Drawing Sheets

COIN DROP MOUNTING MECHANISM

The invention relates generally to a combination of components adapted to affix a coin acceptor mechanism to the panel of a vending machine. More specifically, the invention provides means by which a coin drop mechanism may be retrofitted to the front panel of the meter box of a coin operated clothes washing machine or clothes drying machine in situations where it is impractical or uneconomical to disconnect and/or move the machine from an installed location.

BACKGROUND OF THE INVENTION

The invention will be described with particular reference to the retrofitting of a coin drop mechanism on a coin-operated machine such as a washer or dryer in place of a typical coin slide mechanism with which such machines are conventionally provided. The coin slide mechanism is one in which a coin, for example a quarter, is placed horizontally into a circular recess in a slide portion with the slide pulled fully out. The slide mechanism is then pushed inwardly to carry the coin into the machine where it is discharged through a coin shute into a coin collecting box. If a coin of improper thickness or diameter is placed into the recess, it is not possible to push the slide in. However, because of the construction of the coin slide mechanism, jamming often results.

There is presently available a mechanism which will be called herein "a coin drop mechanism" which does not utilize a coin slide which is capable of jamming. Instead, the user simply inserts the appropriate coin into an entry slide and the internal mechanism is able to distinguish a true coin from slugs or coins of other denominations, any of which are returned through a coin return slide. This mechanism discriminates primarily on the basis of weight, thickness and diameter. This mechanism can also incorporate a magnetic means for trapping ferromagnetic coins or slugs in countries where the intended coin is non-magnetic.

Because none of the moving parts of the coin drop mechanism is manipulated by or accessible to the user within the machine there is less danger of jamming, improper use or vandalism than there is with a coin slide. It has, therefore, become common practice to replace existing coin slide mechanisms with coin drop mechanisms in laundromat washers and dryers.

DESCRIPTION OF THE PRIOR ART

U.S. Pat. No. 4,545,474 which issued Oct. 8, 1985 to Ridgley et al describes a mounting means and method of affixing a coin drop mechanism to existing meter boxes of washing machines and the like. A mounting mechanism which comprises a plate and second plate which are adapted to sandwich between them a panel to which they are affixed. The first plate has at least one boss projecting from a face thereof and threaded means spaced from the boss. The boss defines a lip spaced from the face of the first plate, at least part of the lip being directed generally towards the threaded means. The second plate defines a first edge adopted to be received under the lip, and a second edge adopted to lie adjacent to the threaded means. Each of the plates defines coin insertion and coin return slots which are disposed to be aligned when the plates are sandwiched across the panel of the machines so that coins may be inserted into and returned from the coin drop mechanism.

The coin drop mechanism of U.S. Pat. No. 4,545,474 and the method of installation described therein are effective for retrofitting washing, drying and vending machines in situations where the installer has clear access to both sides of the panel of the meter box to which it is affixed. However in many situations, notably in commercial laundromats and apartment building laundries, the installer is unable to access or even see the rear surface of a vending machine, washer or dryer meter box panel. The weight of such machines and existing plumbing connections makes it undesirable and/or commercially impractical to disconnect and move the machines when retrofitting or servicing coin drop mechanisms. It is therefore desirable to provide means for affixing coin drop mechanisms panels of washing, drying, and other vending machines without close access or visual access to the rear of the panel together with a means for assuring that the installation has been correctly completed.

SUMMARY OF THE INVENTION

In accordance with the invention a coin drop mechanism is affixed to a panel of a vending machine meter box by a fixture which consists of a first plate and second plate adapted to sandwich the panel therebetween. The first plate and the second plate each define slots for coin insertion and coin return, corresponding slots on the first and second plates being aligned when the plates are affixed to the vending machine panel. At least two threaded studs project normal from the rear surface of the first plate through holes in the panel. Corresponding holes in the second plate functioned to align and clamp the two plates together. A guide rod extends concentrically from the end of each stud which is remote from the first plate to provide tactile guidance for aligning the second plate and coin drop mechanism to the back of the panel. Internally threaded tubular locking members are aligned over the guide rods and threaded to the studs to provide clamping action. The guide rods extend through the rear most ends of the locking members and are sized to project from the rear of the locking members to provide a positive tactile gaging function which indicates that the locking members have been fully seated against the second plate and that proper clamping to the panel has been achieved.

In a preferred embodiment, the remote ends of the locking members are provided with hexagonal fixtures so that the locking members can be suitably wrenched on the studs.

The present invention thus has the advantage that the coin acceptor mechanism can be mounted on the front panel of a meter box without visual access to the interior of the meter box or rear surface of the panel and that a technician can verify that the mechanism is fully and firmly seated against the panel before closing the machine.

DESCRIPTION OF THE DRAWINGS

The invention may be understood with reference to the attached drawings in which.

DESCRIPTION OF THE PREFERRED EMBODIMENT

Figure 1:
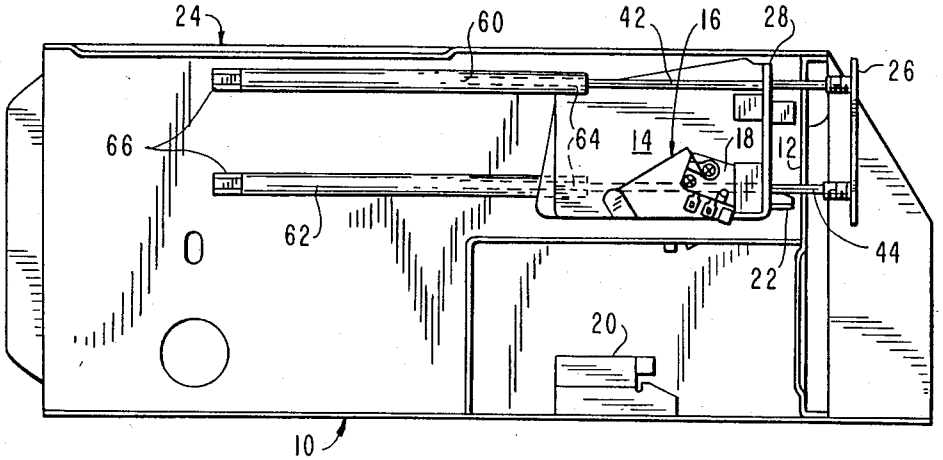
FIG. 1 illustrates the installation of a coin drop mechanism on the meter box of a coin operated washing machine.

FIG. 1 is a cutaway side view of the meter box 10 of a typical coin operated commercial washing machine. Coins to operate the washing machine are inserted through the front panel 12 of the meter box where they are verified by a coin acceptor mechanism 14. If the coins are determined to be valid, they drop passed an arm 16 of a microswitch 18 which can, for example, provide a signal to a coin counting circuit (not illustrated) and are collected in a coin collection box 20 disposed below the microswitch actuator arm 16. If the coin drop mechanism rejects a coin it is returned through a coin return chute 22.

In a typical installation the meter box 10 is firmly affixed to a heavy washing machine which is attached by electrical and plumbing connections to the structure of the laundromat. Frequently, a technician servicing or installing a coin drop mechanism has direct access to the front of the machine but has only limited, tactile access to the interior of the meter box, for example through access opening 24. Visual access to align the internal and external portions of the coin drop mechanism and to verify that installation is correct is practically impossible.

Figure 2:
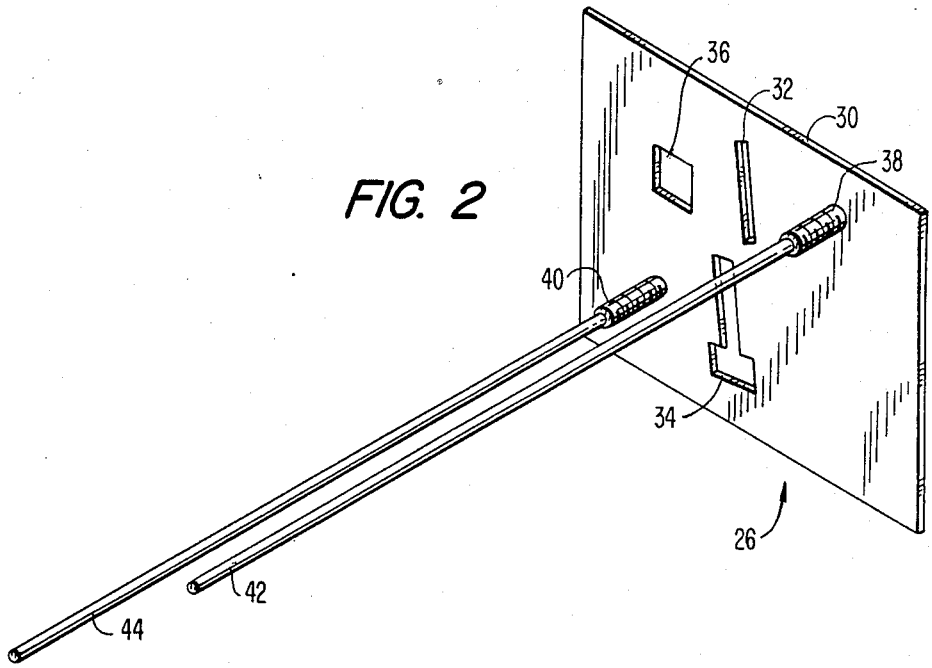
FIG. 2 illustrates the front plate assembly of the invention.
Figure 3:
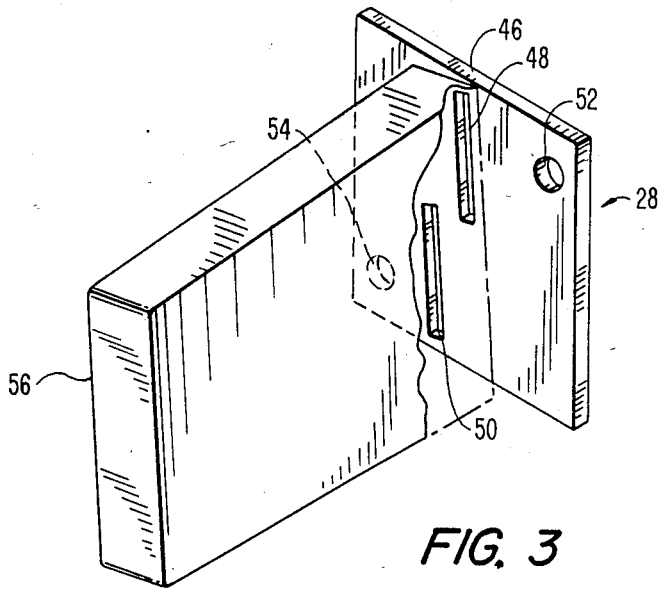
FIG. 3 illustrates the rear plate assembly of the invention.

In accordance with the invention, the coin drop mechanism is secured to the panel 12 of the meter box with a fixture which comprises an outer plate assembly 26 (more particularly described with reference to FIG. 2) and an inner plate assembly 28 (more particularly described with respect to FIG. 3).

Referring to FIG. 2, the outer plate assembly comprises an outer plate 30 which defines a first coin insertion slot 32, a coin return slot 34 and a coin return button aperture 36. A pair of threaded studs 38 and 40 are affixed to a rear surface of the plate 30 and extend normal thereto. In a preferred embodiment the studs 38 and 40 are affixed to the panel 30 by welding, but they may alternately be affixed by other means (for example rivoting) which have immunity to vandalism. The studs are generally disposed on the plate adjacent to and on opposite sides of the coin insertion slot 32.

Guide rods 42 and 44 extend concentrically from the end of each stud which is remote from the plate 30. In a preferred embodiment the studs are internally threaded to accept threaded ends of the guide rods, but the guide rods may also be butt welded directly to the ends of the studs. The external diameter of each of the guide rods is smaller than the external diameter of the corresponding stud.

FIG. 3 illustrates the internal plate assembly. The assembly comprises an internal plate 46 which is provided with a coin insertion slot 48 and coin return slot 50 which are positioned for alignment with the corresponding slots 32 and 34 in the external plate assembly. The internal plate is further provided with a pair of mounting holes 52 and 54 which are positioned to engage the threaded studs 38 and 40 when the panel 12 is sandwiched between the plate assemblies. The coin drop mechanism, which may be any conventional coin drop mechanism, is affixed to the back of the plate 46 so that the slots 48 and 50 of the plate respectively feed coins into and return coins from the coin drop mechanism 56.

The invention further comprises a pair of tubular locking members 60 and 62 (FIG. 1) having first ends 64 which are internally threaded to engage the threads on the studs 38 and 40 and have bores extending from the first ends to second remote ends 66 which are sized to receive the guide rods 42 and 44. The end 66 of the locking members are provided with hexagonal fixtures for receiving the tool which a technician may use to wrench the locking members onto the studs.

In a typical installation, the technician inserts the guide rods of the first plate assembly through the opening in the front panel from the front of the washing machine. The technician then attaches wires from the vending machine to the microswitch of the coin drop mechanism and inserts the second plate assembly, with wires attached, through the access opening 24 on the top of the meter box. The technician tactically aligns the holes 52 and 54 in the second plate assembly over the guide rods 42 and 44 and slides the second plate assembly along the guide rods and over the studs, sandwiching the front panel of the machine between the internal and external plate assemblies. The technician then inserts the locking members 60 and 62 through the access opening 24 and slides them over the guide rods until they are seated against the studs. The locking members are then screwed onto the studs.

In one embodiment of the invention, the guide rods are sized so that the ends of the guide rods remote from the panel just extend through the remote ends 66 of the locking members when the locking member 60 and 62 are fully seated on the studs and the first plate assembly is firmly clamped against the second plate assembly and the front panel. Extending tips of the guide rods provide tactile information that the installation has been completed without the necessity for visual inspection.

What is claimed is:

1. A coin drop mechanism for installation on a panel of a meter box of a vending machine comprising, in combination:

a first plate defining a first slot for coin insertion;

a second plate defining a second slot for coin insertion;

the first and second plates being adapted to sandwich between them the panel of the meterbox so that the first slot and the second slot are aligned to permit passage of coins;

two threaded studs, each stud having a first end which is attached to a rear surface of the first plate so that the studs extend normal from the rear surface adjacent opposite sides of the first slot;

two guide rods, each guide rod being concentrically affixed to and extending from an end of a corresponding one of the studs, which end is remote from the rear surface, and having an external diameter which is smaller than the external diameter of the corresponding stud;

said second plate further defining two holes which are disposed to engage the studs when the panel is sandwiched between the plates and the slots are aligned; and two tubular locking members, each locking member having an internally threaded first end adapted for engagement with one of the studs, an opposite, fixtured second end adapted for engagement with an installation tool, the locking members each further defining an internal passage which extends from the first end, concentric with the internal thread and which is adapted to receive one of the guide rods to align the internal thread with the stud.

2. The mechanism of claim 1 wherein the internal passages extend through the locking members, from the first end to the second end, and the lengths of the guide rods are selected so that the rods extend from the second ends of the locking members as gauges when the plates are seated against the panel and the locking members are seated on the studs against the second plate.

3. The mechanism of claim 1 further comprising a coin acceptor attached to the second plate.

4. The mechanism of claim 1 wherein each of the plates further define coin return slots which are disposed to be aligned to permit passage of coins when the plates are affixed to the panel.

5. The mechanism of claim 1 wherein the fixtured second ends of the locking members are hexagonal.

* * * * *